US007160077B2

(12) United States Patent
Westendorf et al.

(10) Patent No.: US 7,160,077 B2
(45) Date of Patent: Jan. 9, 2007

(54) GRAPPLE ASSEMBLY, A FRONT END LOADER HAVING A GRAPPLE ASSEMBLY, AND METHOD FOR OPERATING A GRAPPLE ASSEMBLY

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 10/934,749

(22) Filed: Sep. 3, 2004

(65) Prior Publication Data

US 2006/0051193 A1 Mar. 9, 2006

(51) Int. Cl.
*B66C 1/00* (2006.01)

(52) U.S. Cl. ..... 414/729; 294/88; 294/106

(58) Field of Classification Search ..... 414/729, 414/739; 901/30, 31, 37; 294/86.4, 87.1, 294/88, 104, 106, 107
See application file for complete search history.

(56) References Cited

U.S. PATENT DOCUMENTS

| | | | | |
|---|---|---|---|---|
| 2,326,338 | A | 8/1943 | Drott et al. | |
| 2,812,595 | A | 11/1957 | Drott et al. | |
| 3,077,999 | A | 2/1963 | Svoboda | |
| 3,243,905 | A | 4/1966 | Ulrich | |
| 3,344,540 | A | 10/1967 | Ulrich | |
| 3,455,477 | A | 7/1969 | Blair | |
| 3,512,665 | A | 5/1970 | Westendorf | |
| 3,817,567 | A * | 6/1974 | Lull | 294/88 |
| 4,030,625 | A | 6/1977 | Koehnen | |
| 4,085,856 | A | 4/1978 | Westendorf | |
| RE29,805 | E | 10/1978 | Koehnen | |
| 4,266,819 | A | 5/1981 | Pemberton | |
| 4,423,997 | A | 1/1984 | Pemberton | |
| 4,538,955 | A | 9/1985 | Langenfeld et al. | |
| 4,565,485 | A | 1/1986 | Wilman | |

(Continued)

OTHER PUBLICATIONS

Brochure, The Loader Specialist, WL Series.

(Continued)

*Primary Examiner*—Donald Underwood
(74) *Attorney, Agent, or Firm*—Merchant & Gould, P.C.

(57) ABSTRACT

A grapple assembly for attachment to a boom assembly of a front end loader is provided. The grapple assembly includes a first pinching arm having a first end constructed for grappling an article and a second end constructed for attachment to the boom assembly at a first attachment arm connection, the first pinching arm having a first pinching arm connection. The grapple assembly also includes a second pinching arm having a first end constructed for grappling an article and a second end constructed for attachment to the boom assembly at a second attachment arm connection, the second pinching arm having a second pinching arm connection. A rotation arm constructed for attachment to the boom assembly at an attachment cylinder connection is provided, the rotation arm having a first rotation arm connection and a second rotation arm connection. A first pinching arm linkage is attached to the rotation arm at the first rotation arm connection and is attached to the first pinching arm at the first pinching arm connection. A second pinching arm linkage is attached to the rotation arm at the second rotation arm connection and is attached to the second pinching arm at the second pinching arm connection. Rotation of the rotation arm relative to the boom assembly causes the first pinching arm and the second pinching arm to move between a closed position and an open position. A method for operating a grapple assembly is provided.

13 Claims, 13 Drawing Sheets

U.S. PATENT DOCUMENTS

| | | | | | |
|---|---|---|---|---|---|
| 4,566,844 | A | | 1/1986 | Campin | |
| 4,606,692 | A | | 8/1986 | Langenfeld et al. | |
| 4,787,811 | A | | 11/1988 | Langenfeld et al. | |
| 4,818,005 | A | * | 4/1989 | Purser | 294/88 |
| 4,930,974 | A | | 6/1990 | Langenfeld et al. | |
| 5,073,080 | A | | 12/1991 | Blum | |
| 5,121,557 | A | | 6/1992 | Moore | |
| 5,184,934 | A | | 2/1993 | Gallo | |
| 5,516,174 | A | | 5/1996 | Squyres | |
| 5,535,533 | A | * | 7/1996 | Romanchok | 37/403 |
| 5,564,885 | A | | 10/1996 | Staben, Jr. | |
| 5,779,430 | A | | 7/1998 | Ball | |
| 5,788,300 | A | | 8/1998 | Dickison et al. | |
| 5,957,650 | A | | 9/1999 | Rollo | |
| 5,997,237 | A | | 12/1999 | Langenfeld et al. | |
| 6,098,320 | A | | 8/2000 | Wass | |
| 6,176,531 | B1 | * | 1/2001 | Wheeler | 294/88 |
| 6,523,284 | B1 | | 2/2003 | Clugston | |
| 6,582,177 | B1 | | 6/2003 | Westendorf et al. | |
| 6,601,891 | B1 | | 8/2003 | Gregory, Jr. | |

OTHER PUBLICATIONS

SP-43 Bale Lift Operator's Manual.
MDS Manufacturing Co., Inc., Attachment Specialists.

* cited by examiner

GRAPPLE ASSEMBLY, A FRONT END LOADER HAVING A GRAPPLE ASSEMBLY, AND METHOD FOR OPERATING A GRAPPLE ASSEMBLY

FIELD OF THE INVENTION

The invention relates to a grapple assembly, a front end loader having a grapple assembly, and a method for operating a grapple assembly. The grapple assembly can be provided without the use of additional cylinders, valves or hydraulic controls other than the ones that are already found on a front end loader.

BACKGROUND OF THE INVENTION

Conventional front end loaders have a pair of boom assemblies pivotally secured at their rearward ends to the tractor and pivotally secured at their front ends to an attachment. Typical attachments used on front end loaders include buckets, clam shells, plows, fork lifts, bale spears, etc. Hydraulic cylinders are usually pivotally connected to the rearward end of the attachment.

Exemplary front end loaders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf, U.S. Pat. No. 4,606,692 to Langenfeld et al.; and U.S. Pat. No. 4,930,974 to Langenfeld et al.

SUMMARY OF THE INVENTION

A grapple assembly for attachment to a boom assembly of a front end loader is provided. The grapple assembly includes a first pinching arm having a first end constructed for grappling an article and a second end constructed for attachment to the boom assembly at a first attachment arm connection, the first pinching arm having a first pinching arm connection. The grapple assembly also includes a second pinching arm having a first end constructed for grappling an article and a second end constructed for attachment to the boom assembly at a second attachment arm connection, the second pinching arm having a second pinching arm connection. A rotation arm constructed for attachment to the boom assembly at an attachment cylinder connection is provided, the rotation arm having a first rotation arm connection and a second rotation arm connection. A first pinching arm linkage is attached to the rotation arm at the first rotation arm connection and is attached to the first pinching arm at the first pinching arm connection. A second pinching arm linkage is attached to the rotation arm at the second rotation arm connection and is attached to the second pinching arm at the second pinching arm connection. Rotation of the rotation arm relative to the boom assembly causes the first pinching arm and the second pinching arm to move between a closed position and an open position.

A method for operating a grapple assembly attached to a boom assembly is provided according to the invention. The method includes a step of extending an attachment cylinder of the boom assembly to cause the grapple assembly provided according to the invention to come to an open position.

An advantage of the present invention is that it provides a grapple assembly that relies upon the existing hydraulic cylinders of a front end loader to enable it to grapple an article. The grapple assembly can be provided without the expense of additional cylinders, hoses, control valves or loader modifications for controls. Furthermore, the grapple assembly can be provided with pinching arms that enable the operator to pick up or grab and carry odd or irregular shaped objects. A front end loader including a right boom assembly and a left boom assembly can include a grapple assembly on each boom assembly. The right and the left grapple assemblies can be constructed such that the pinching arms of the right grapple assembly can be operated to hold an article of a different size than the pinching arms of the left grapple assembly without requiring separate hydraulic circuits for each.

BRIEF DESCRIPTION OF THE DRAWINGS

FIG. 12(*b*) is a side view of a third embodiment of pinching arms constructed for use with the grapple assemblies of FIGS. 1 and 6;

DETAILED DESCRIPTION OF THE PREFERRED EMBODIMENT

Figure 1:
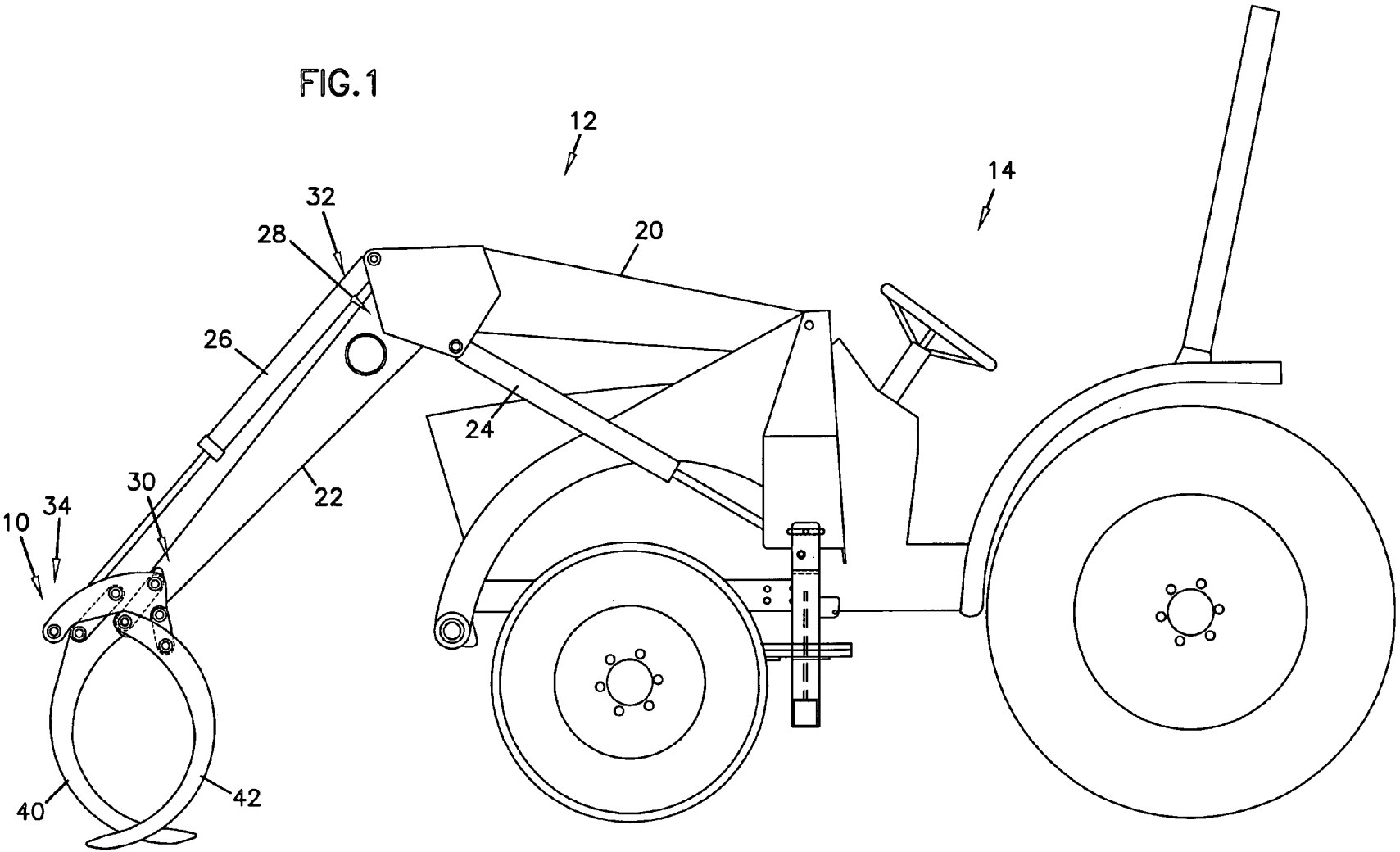
FIG. 1 is a side view of a tractor including a front end loader with a grapple assembly according to the principles of the invention mounted thereon.
Figure 2:
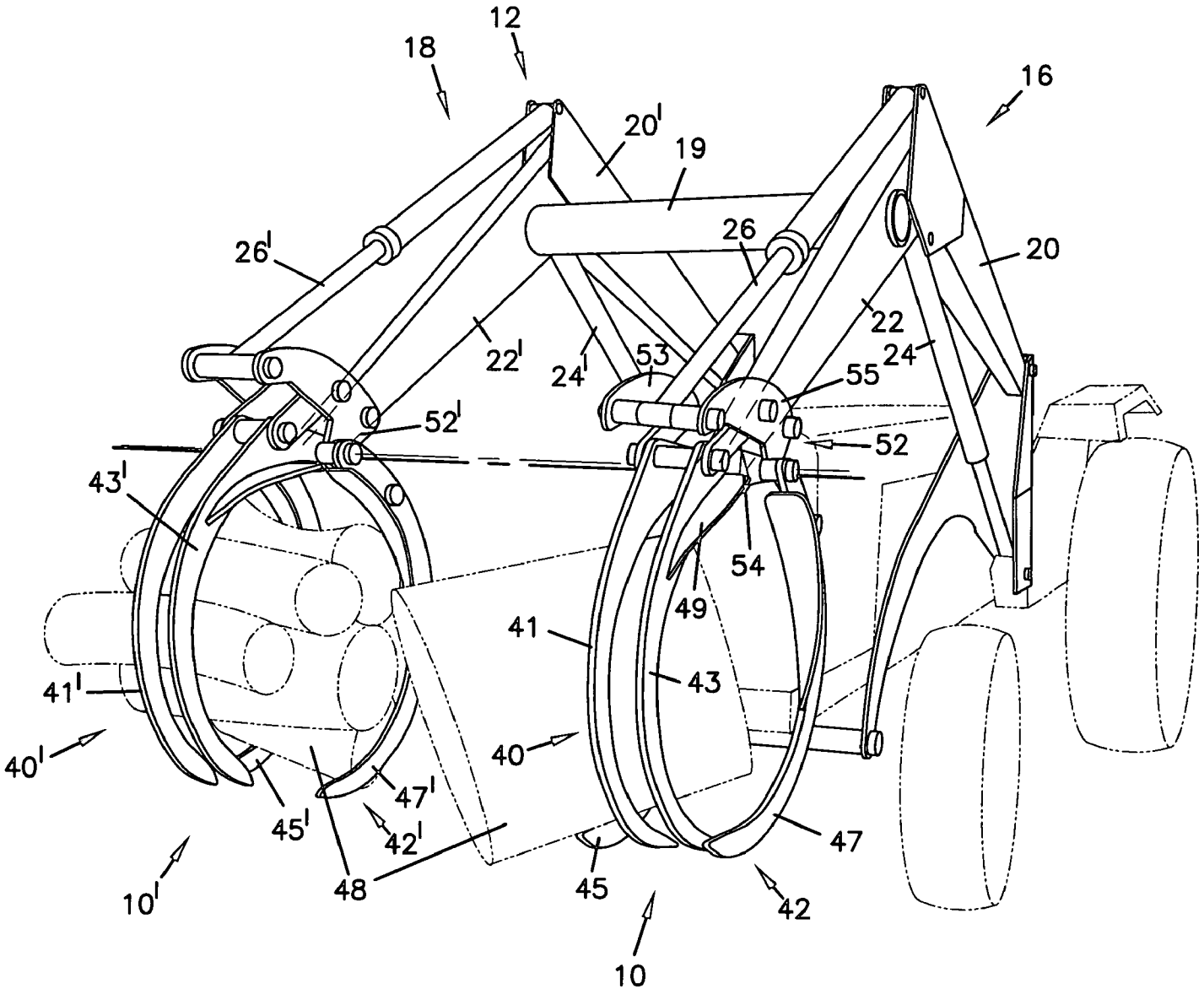
FIG. 2 is a perspective view of the front end loader with the grapple assembly of FIG. 1 mounted thereon.

A grapple assembly according to the invention is shown in FIGS. 1–5A at reference numeral 10. Referring to FIGS. 1 and 2, the grapple assembly 10 is shown attached to a front end loader 12 on a tractor 14.

It will be understood that the invention is not limited to use with the particular configuration of the tractor 14 and the front end loader 12 illustrated in FIG. 1, but that the tractor 14 and the particular front end loader 12 configuration illustrated in FIG. 1 are simply representative of one embodiment of a motor vehicle and front end loader combination that can be used to practice the principles of the present invention.

Referring to FIG. 2, the front end loader 12 generally includes a left boom assembly 16 and a right boom assembly 18 that generally include corresponding structure. The left boom assembly 16 and the right boom assembly 18 can be referred to as the first boom assembly 16 and the second boom assembly 18. As shown in FIG. 2, the left boom assembly 16 and the right boom assembly 18 are connected together by a crossbar 19. The crossbar 19 can be used to convey and conceal hydraulic lines between the right boom assembly 18 and the left boom assembly 16 as disclosed in U.S. application Ser. No. 10/719,677 that was filed with the United States Patent and Trademark Office on Nov. 21, 2003, the entire disclosure of which is incorporated herein by reference. It should be understood that the front end loader 12 can also be provided without the crossbar 19.

A front end loader, such as the front end loader 12 depicted in FIGS. 1 and 2, including a right boom assembly and a left boom assembly can include a grapple assembly on each boom assembly.

There may be certain differences between the structure of the left boom assembly 16 and the right boom assembly 18. In general, the following discussion will refer to structure that is present on both the left boom assembly 16 and the right boom assembly 18. Unless indicated differently, corresponding structure, when identified, will be characterized on the right boom assembly 18 using the same reference number used on the left boom assembly 16, except that the reference numerals identifying corresponding structure on the right boom assembly will include an apostrophe.

Referring back to FIG. 1, the left boom assembly 16 of the front end loader 12 generally includes a loader arm 20, an attachment arm 22, a lift cylinder 24, and an attachment cylinder 26. The attachment arm 22 includes a first attachment arm end 28 and a second attachment arm end 30. The second attachment arm end 30 is provided for mounting the grapple assembly 10 of the present invention to the front end loader 12. The second attachment arm end 30 can also be used to mount various other attachments to the front end loader 12 including buckets, clam shells, plows, fork lifts, bale spears, etc.

The lift cylinder 24 is provided for generating lift of the grapple assembly 10. The attachment cylinder 26 is provided for controlling the movement of the grapple assembly 10. The attachment cylinder 26 includes a first attachment cylinder end 32 and a second attachment cylinder end 34. The second attachment cylinder end 34 is provided for mounting the grapple assembly 10 of the present invention or other conventional attachments to the front end loader 12. The attachment cylinders 26 and 26' (see FIG. 2) may be hydraulically arranged to run in parallel.

Figure 5A:
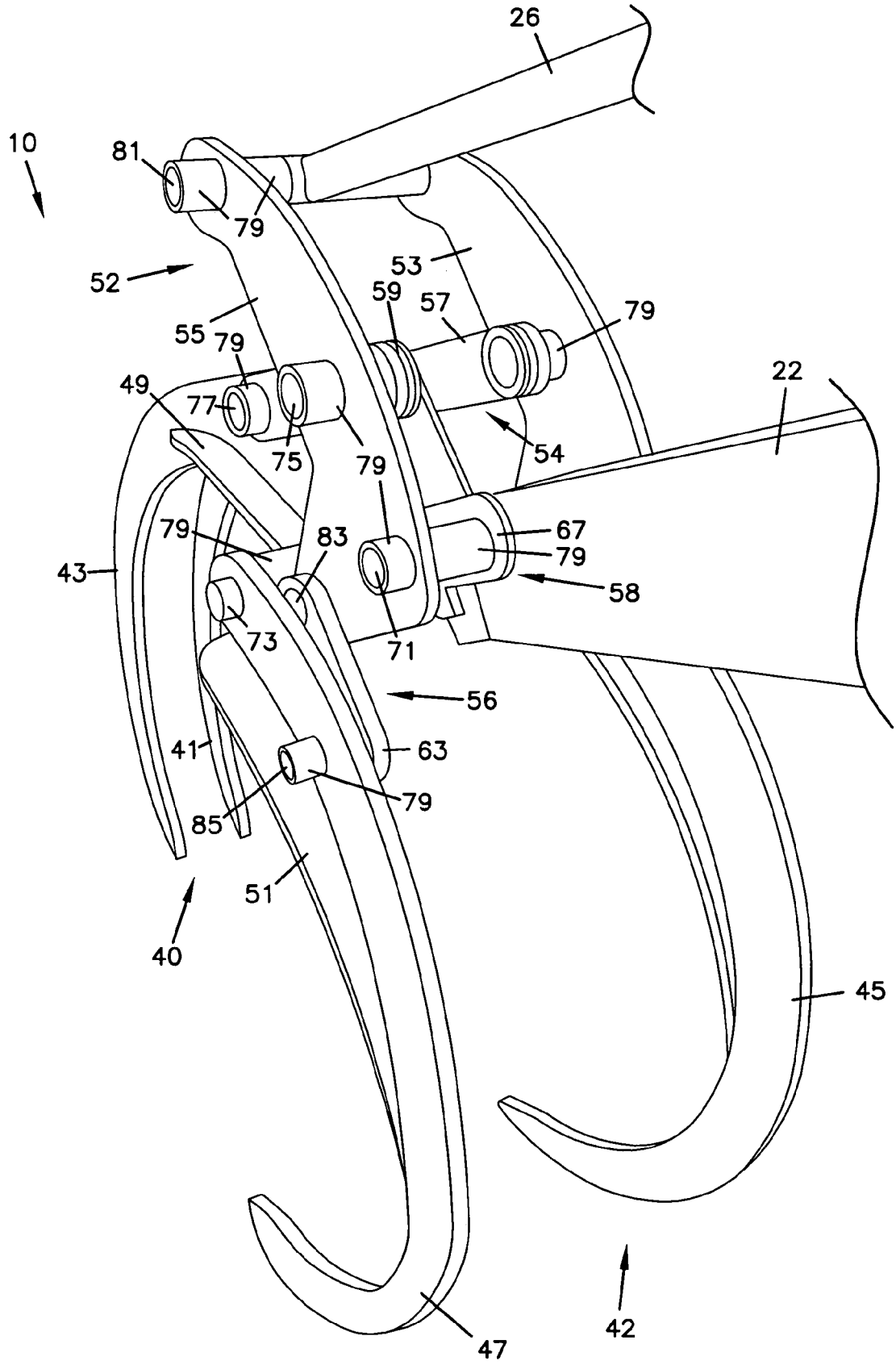
FIG. 5A is a perspective view of the grapple assembly of FIG. 1.
Figure 5B:
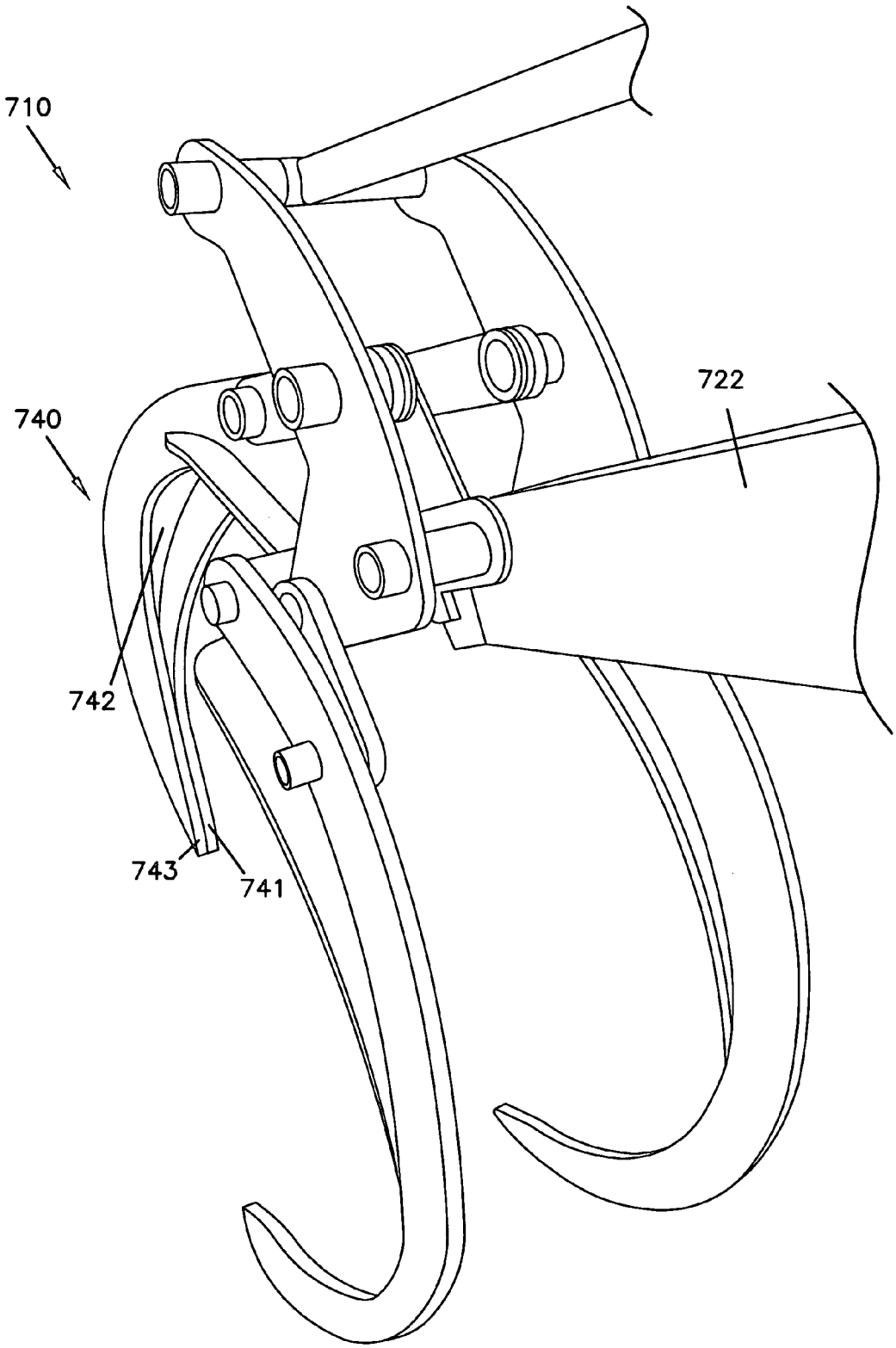
FIG. 5B is a perspective view of an embodiment of a grapple assembly including similar features to the grapple assembly of FIG. 1, including an alternative embodiment of an upper pinching arm.

Referring to FIGS. 2 and 5A, the grapple assembly 10 includes an upper pinching arm generally indicated at 40 and a lower pinching arm generally indicated at 42. The upper pinching arm 40 and the lower pinching arm 42 can be referred to as the first pinching arm 40 and the second pinching arm 42. The first pinching arm 40 can include a right first pinching arm 41 disposed on the right side of the attachment arm 22 and a left first pinching arm 43 disposed on the left side of the attachment arm 22. The second pinching arm 42 can include a right second pinching arm 45 disposed on the right side of the attachment arm 22 and a left second pinching arm 47 disposed on the left side of the attachment arm 22.

The grapple assembly 10 includes a rotation arm 52. The rotation arm 52 can include a first rotation arm 53 disposed on the right side of the attachment cylinder 26 and a second rotation arm 55 disposed on the left side of the attachment cylinder 26.

The grapple assembly 10 also includes an upper pinching arm linkage 54. The upper pinching arm linkage 54 can include a first upper pinching arm linkage 57 disposed on the right side of the attachment arm 22 and a second upper pinching arm linkage 59 disposed on the left side of the attachment arm 22.

The grapple assembly 10 also includes a lower pinching arm linkage 56. The lower pinching arm linkage 56 can include a first lower pinching arm linkage (not shown in Figures) disposed on the right side of the attachment arm 22 and a second lower pinching arm linkage 63 (see FIG. 5A) disposed on the left side of the attachment arm 22.

The grapple assembly may also include an insert member 58. The insert member 58 can include a first insert member disposed on the right side of the attachment arm 22 (not shown in Figures) and a second insert member 67 (see FIG. 5A) disposed on the left side of the attachment arm 22.

The upper pinching arm 40, the lower pinching arm 42, the rotation arm 52, the upper pinching arm linkage 54, and the lower pinching arm linkage 56 all rotate relative to each other. The insert member 58 is coupled to the attachment arm 22 of the boom assembly 16 such that it does not move relative to the attachment arm.

The first pinching arm 40 and the second pinching arm 42 are constructed to move relative to each other to allow the first pinching arm 40 and the second pinching arm 42 to grab and hold any article that will fit between the first pinching arm 40 and the second pinching arm 42 such as a bale of hay or logs 48.

The grapple assemblies 10 and 10' can be operated by the attachment cylinders 26 and 26', respectively. As discussed previously, one advantage of the present invention is that the grapple assemblies 10 and 10' can be operated by the existing hydraulic cylinders of the front end loader to enable it to grapple articles. The grapple assemblies may, therefore, be provided without the expense of additional cylinders, hoses, control valves or loader modifications for controls.

Furthermore, as shown in FIG. 2, the grapple assemblies 10 and 10' can hold different sized articles without requiring separate hydraulic circuits for each. When the attachment cylinder 26 is actuated to bring the pinching arms 40 and 42 toward each other, the first and the second pinching arms 40 and 42 move toward each other until an article grappled by the pinching arms stops their movement. However, pinching arms 40' and 42' located on the right grapple assembly 10' may continue to move toward each other until an article, for example a smaller article, grabbed by them stops their movement. In this manner, the pinching arms 40 and 42 of the grapple assembly 10 and pinching arms 40' and 42' of the grapple assembly 10' can grapple and hold articles of different sizes without requiring separate hydraulic circuits for the grapple assemblies 10 and 10'.

The upper pinching arm 40 and the lower pinching arm 42 can include an upper pinching finger flange portion 49 and a lower pinching finger flange portion 51, respectively, constructed to provide increased contact surface area for the pinching arms to hold articles.

Figure 4:
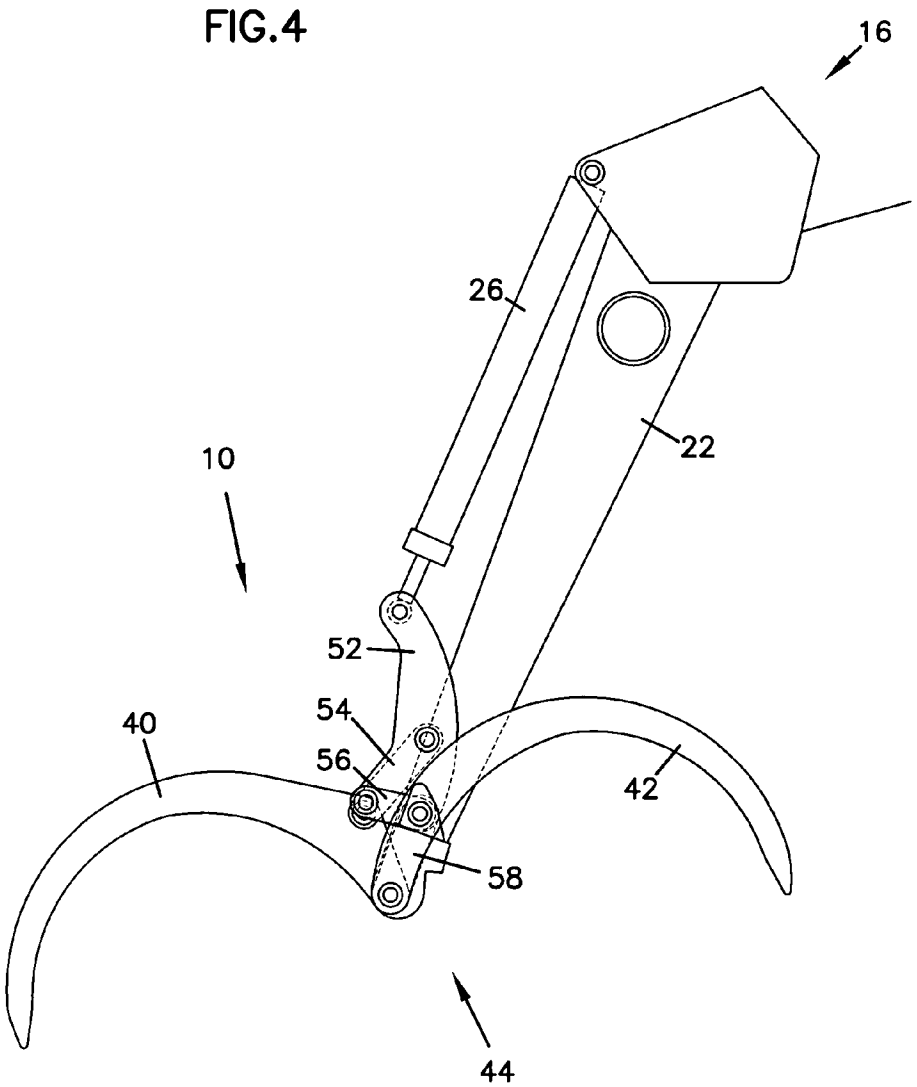
FIG. 4 is a side view of the grapple assembly of FIG. 1, showing the pinching arms in an open position.
Figure 3:
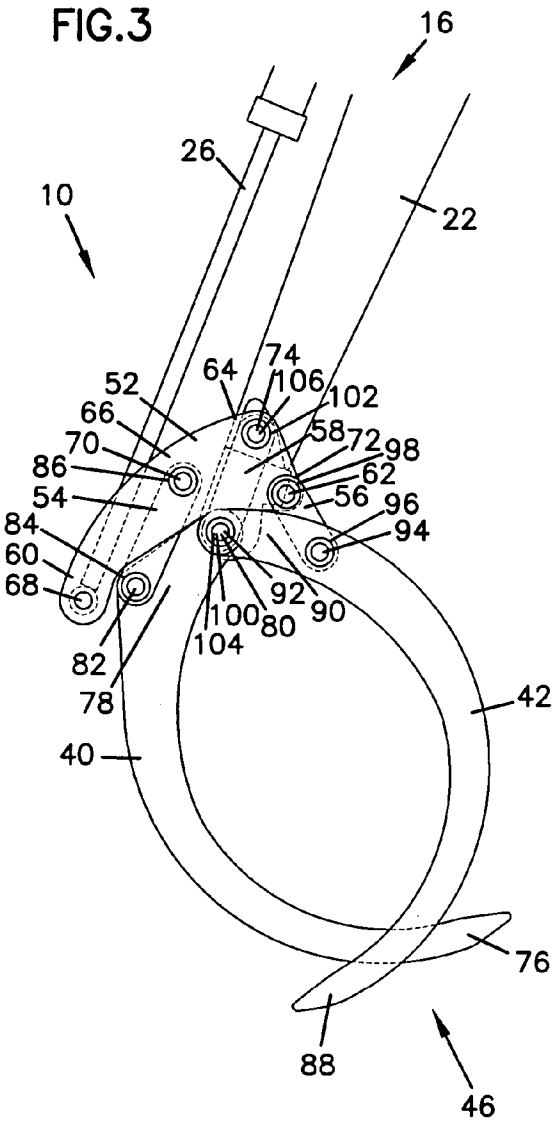
FIG. 3 is a side view of the grapple assembly of FIG. 1, showing the pinching arms in a closed position.

Referring to FIGS. 3 and 4, the rotation arm 52 includes a front comer 60, a lower back comer 62, an upper back comer 64, and a center portion 66. The rotation arm 52 includes an attachment cylinder connection 68 in the lower front comer 60 for attachment to the attachment cylinder 26 of the left boom assembly 16. The rotation arm 52 includes a first rotation arm connection 70 at the center portion 66 for attachment to the upper pinching arm linkage 54 and a second rotation arm connection 72 at the lower back corner 62 for attachment to the lower pinching arm linkage 56. The rotation arm 52 also includes an attachment arm connection 74 at the upper back corner 64 for attachment to the attachment arm 22 of the boom assembly 16.

The upper pinching arm 40 includes a first end 76 constructed for grappling an article and a second end 78 with a first attachment arm connection 80 and a first pinching arm connection 82. The first attachment arm connection 80 provides for attachment to the attachment arm 22 of the boom assembly 16. The first pinching arm connection 82 provides for attachment to the upper pinching arm linkage 54.

The upper pinching arm linkage 54 includes a first end 84 and a second end 86. The upper pinching arm linkage 54 includes the upper pinching arm connection 82 at the first end 84 and the first rotation arm connection 70 at the second end 86. The upper pinching arm linkage 54 provides attachment between the rotation arm 52 and the upper pinching arm 40.

The lower pinching arm 42 includes a first end 88 constructed for grappling an article and a second end 90 having a second attachment arm connection 92 and a second pinching arm connection 94. The second attachment arm connection 92 provides for attachment to the attachment arm 22 of the boom assembly 16. The second pinching arm connection 94 provides for attachment to the lower pinching arm linkage 56.

The lower pinching arm linkage 56 includes a first end 96 and a second end 98. The lower pinching arm linkage 56 includes the lower pinching arm connection 94 at the first end 96 and the second rotation arm connection 72 at the second end 98. The lower pinching arm linkage 56 provides connection between the rotation arm 52 and the lower pinching arm 42.

In the grapple attachment assembly 10, as illustrated in FIGS. 3–5A, the insert member 58 provides spacing or separation between the rotation arm 52 and the attachment arm 22 of the boom assembly 16 (see FIG. 5A). The insert member 58 includes a front end 100 and a back end 102. The insert member 58 includes a front end attachment arm connection 104 at the front end 100 and a back end attachment arm connection 106 at the back end 102.

The connections among the various components of the grapple attachment assembly 10 described above may be provided by various means known in the art, including pins with clips, fasteners such as nuts and bolts, etc.

FIG. 3 illustrates a side view of the grapple assembly 10, showing the relative orientation of the various components when the pinching arms 40 and 42 of the grapple assembly 10 are in a closed position 46. FIG. 4 illustrates a side view of the grapple assembly 10, showing the relative orientation of the various components when the pinching arms 40 and 42 of the grapple assembly 10 are in an open position 44.

It will be understood that the terms "opening" and "closing" of the pinching arms do not refer solely to bringing the pinching arms to positions 44 and 46 respectively. "Opening" of the pinching arms refers to moving the upper pinching arm and the lower pinching arm away from each other within any position between the closed position 46 and the open position 44. "Closing" of the pinching arms refers to moving the upper pinching arm and the lower pinching arm toward each other within any position between the open position 44 and the closed position 46.

Although the relative layering of the individual components of the grapple assembly 10 is shown in FIGS. 1, 3 and 4 with hidden lines, FIG. 5A illustrates a perspective view of the grapple assembly 10, showing the relative layering and the relative spacing of the individual components of the grapple assembly 10.

As depicted in FIG. 5A, the insert member 58 is connected to the attachment arm 22 via rotation pin 71. The upper pinching arm 40 is connected to the front end 100 (see FIG. 3) of the insert member 58 and to the attachment arm 22 via rotation pin 73. The rotation arm 52 is connected to the insert member 58 via rotation pin 71. The upper pinching arm linkage 54 extends between the rotation arm 52 and the upper pinching arm 40, being connected to the rotation arm 52 via rotation pin 75 and to the upper pinching arm 40 via rotation pin 77. The rotation arm 52 is connected to the attachment cylinder 26 via rotation pin 81. The lower pinching arm linkage 56 is connected to the rotation arm 52 via rotation pin 83 and connected to the lower pinching arm 42 via rotation pin 85. The lower pinching arm 42 is connected to the upper pinching arm 40, to the insert member 58, and to the attachment arm 22 via rotation pin 73. As depicted in FIG. 5A, sleeves 79 can also be provided to increase surface area of connection or to provide spacing between the various components of the grapple attachment assembly 10.

It will be understood that the depicted layering of the various components of the grapple attachment assembly 10 in FIG. 5A is one example of many possible configurations that can be utilized within the scope of the invention. Although, in FIG. 5A, all the connections between the various components of the grapple attachment assembly 10 are depicted to be provided with pins, other means of attachment known in the art can also be utilized.

FIGS. 1–5A illustrate only one of many different embodiments of pinching arm configurations that may be provided with the grapple attachment assembly 10 of the invention. Other alternative embodiments of the pinching arms can be provided for the grapple attachment assembly. FIG. 5B illustrates one such alternative embodiment of pinching fingers. The grapple attachment assembly 710 illustrated in FIG. 5B includes similar features to the grapple assembly 10 of FIG. 1, except that grapple assembly 710 includes an upper pinching arm 740 that has a different configuration than that of the grapple assembly 10 of FIG. 1. The upper pinching arm 740 is configured, for example, by bending and welding together a right first pinching arm 741 disposed on the right side of the attachment arm 722 and a left first pinching arm 743 disposed on the left side of the attachment arm 722 of the grapple assembly 710. For additional strength, a triangular plate 742 may be provided between the right and the left pinching arms as seen in FIG. 5B. The plate 742 may be coupled to the pinching arms by welding or by other various methods.

An alternative grapple assembly 110 according to the principles of the invention is illustrated in FIGS. 6–9.

The grapple assembly 110 illustrated in FIGS. 6–9 is similar to the grapple assembly 10 illustrated in FIGS. 1–5A except that the grapple attachment assembly 110 requires an attachment sleeve 111 to be inserted onto the attachment arm 122 before assembling the grapple assembly 110. The attachment sleeve 111 includes a front end 113 and a back end 115. The attachment sleeve 111 provides for an attachment arm connection 117 at the front end 113 and an attachment arm connection 119 at the back end 115. The attachment sleeve 111 is used with attachment arm configurations that do not include two slots for attachment purposes. The attachment sleeve 111 provides an attachment arm connection 174 for the rotation arm 152. The attachment sleeve 111 also provides separation between the upper pinching arm 140 and the attachment arm 122 of the boom assembly 116.

The grapple assembly 110 of FIGS. 6–9 is not depicted to include an insert member such as the one used for the grapple assembly 10 of FIGS. 3 and 4. However, it can be provided with one. The grapple assembly 110 includes an upper pinching arm 140, a lower pinching arm 142, a rotation arm 152, an upper pinching arm linkage 154, and a lower pinching arm linkage 156.

As in the grapple assembly 10 of FIGS. 1–5A, the rotation arm 152 includes an attachment cylinder connection 168, a first rotation arm connection 170, a second rotation arm connection 172, and an attachment arm connection 174.

The upper pinching arm 140 includes a first end 176 constructed for grappling an article and a second end 178 with a first attachment arm connection 180 and a first pinching arm connection 182.

The upper pinching arm linkage 154 includes a curved shape with a first end 184 and a second end 186. The upper pinching arm linkage 154 includes the upper pinching arm connection 182 at the first end 184 and the first rotation arm connection 170 at the second end 186.

The lower pinching arm 142 includes a first end 188 constructed for grappling an article and a second end 190 having a second attachment arm connection 192 and a second pinching arm connection 194.

The lower pinching arm linkage 156 is similarly shaped to that of the embodiment of FIGS. 1–5 and includes a first end 196 and a second end 198. The lower pinching arm linkage 156 includes the lower pinching arm connection 194 at the first end 196 and the second rotation arm connection 172 at the second end 198.

The individual components of the grapple assembly of FIGS. 6–9 can be coupled to each other in a similar manner as previously described for the grapple assembly 10 of FIGS. 1–5A.

Figure 6:
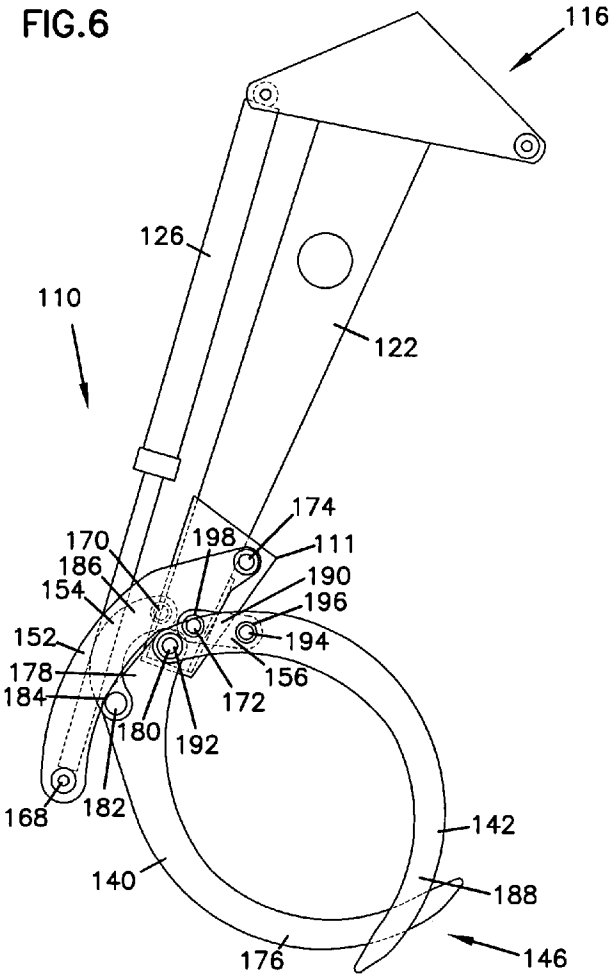
FIG. 6 is a side view of an alternative embodiment of a grapple assembly according to the principles of the invention, showing the pinching arms in a closed position.

FIG. 6 illustrates a side view of the grapple assembly 110, showing the relative orientation of the individual components when the pinching arms 140 and 142 are in a closed position 146.

Figure 7:
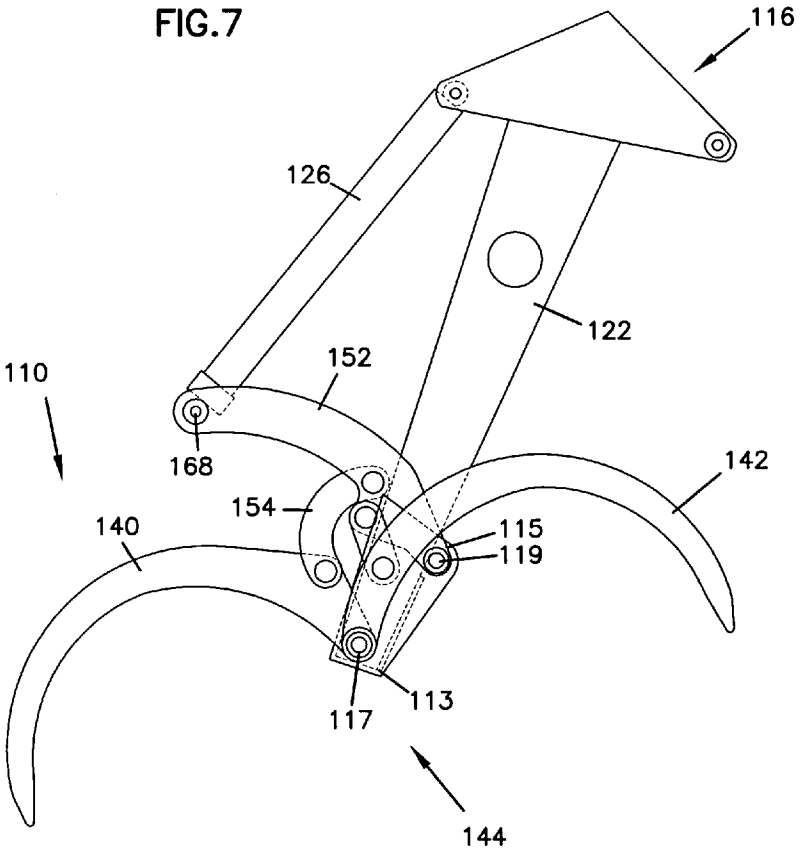
FIG. 7 is a side view of the grapple assembly of FIG. 6, showing the pinching arms in an open position.

FIG. 7 illustrates a side view of the grapple assembly 110, showing the relative orientation of the individual components when the pinching arms 140 and 142 are in an open position 144.

Figure 8:
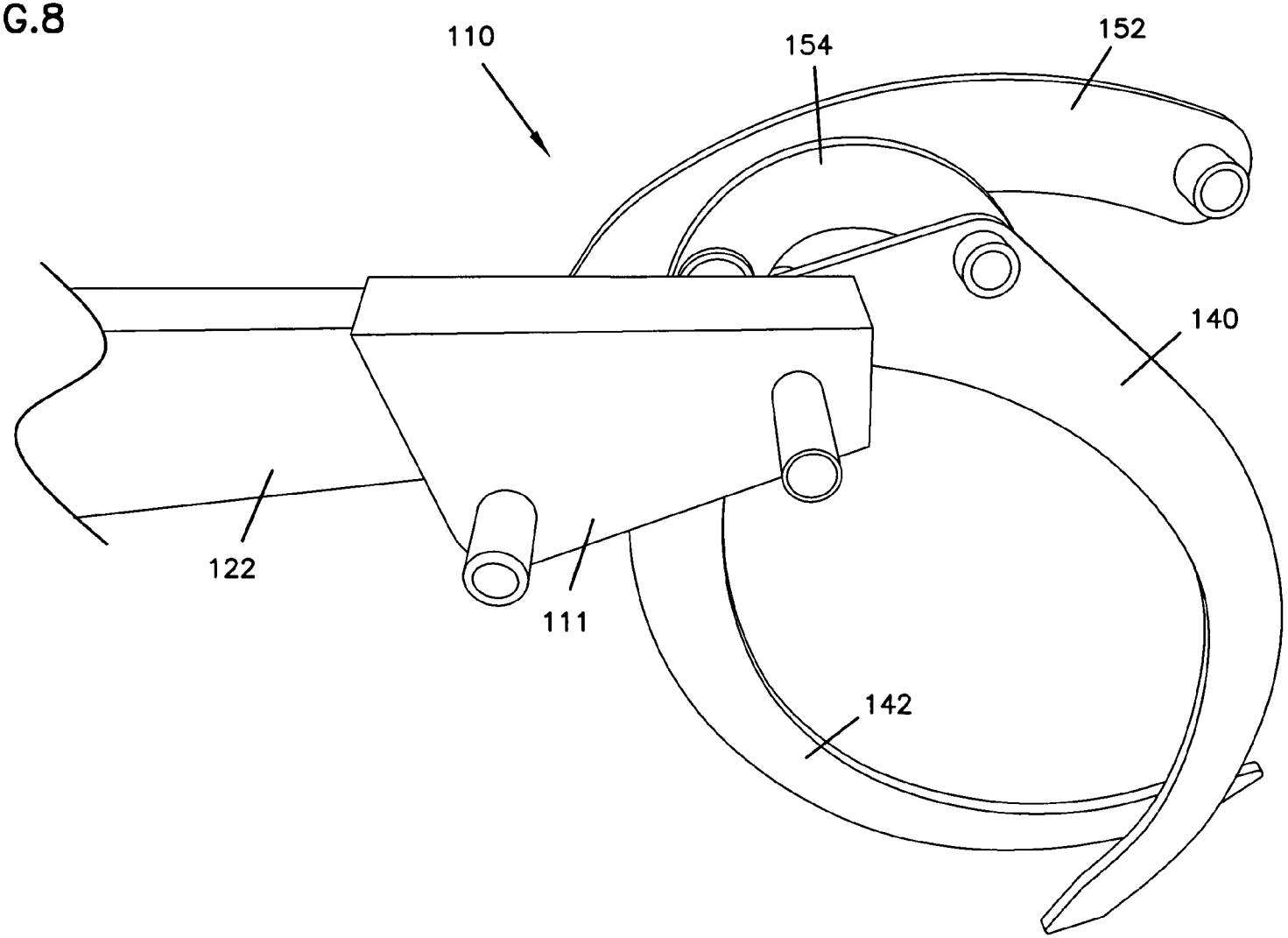
FIG. 8 is a perspective view of a part of the grapple assembly of FIG. 6.

Although the relative layering of the individual components is shown in FIGS. 6 and 7 with hidden lines, FIG. 8 illustrates a perspective view of a partially assembled grapple assembly 110, showing the relative layering of the individual components and the relative spacing between the individual components of the grapple assembly 110.

Figure 9:
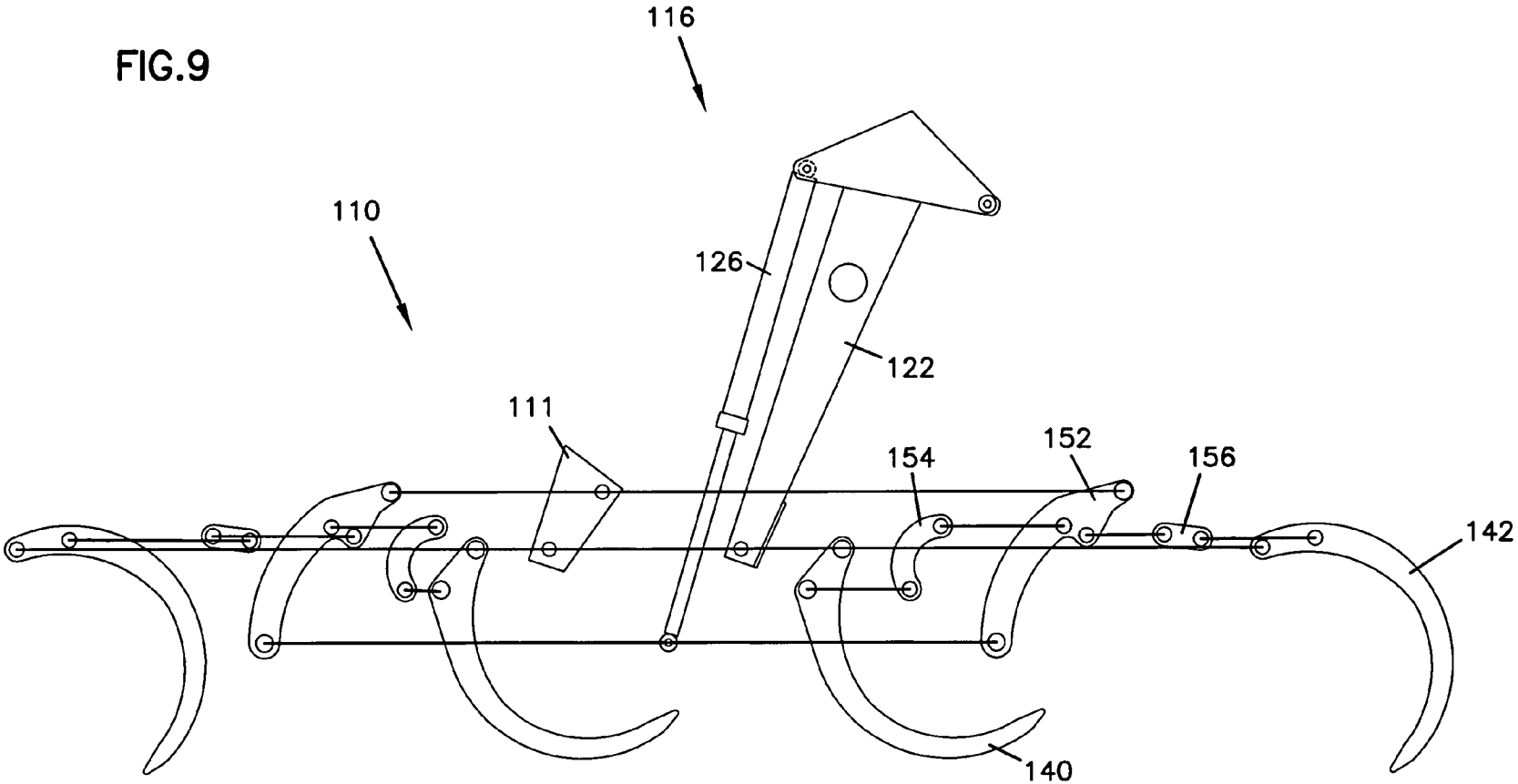
FIG. 9 is an exploded side view of the grapple assembly of FIG. 6.

FIG. 9 is an exploded side view of the grapple assembly 110 of FIGS. 6–8.

Figure 11:
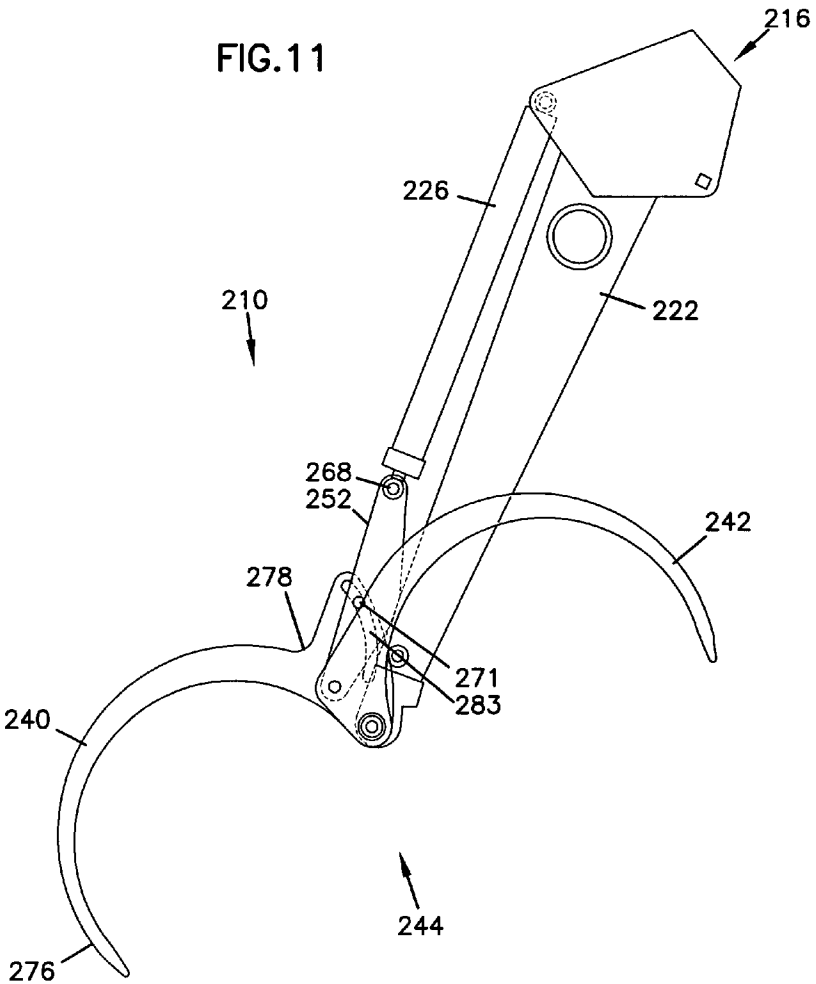
FIG. 11 is a side view of the grapple assembly of FIG. 10, showing the pinching arms in an open position.
Figure 10:
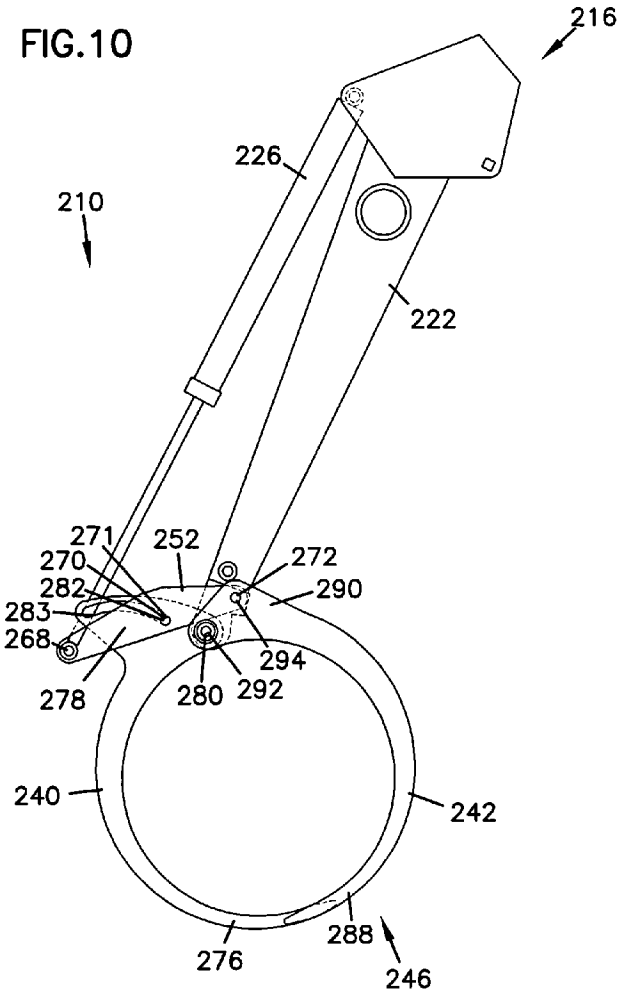
FIG. 10 is a side view of a third embodiment of a grapple assembly according to the principles of the invention, showing the pinching arms in a closed position.

A third embodiment of a grapple assembly 210 according to the principles of the invention is illustrated in FIGS. 10 and 11.

The grapple assembly 210 illustrated in FIGS. 10 and 11 is similar to the grapple assembly 10 illustrated in FIGS. 1–5 except that the grapple assembly 210 does not require upper and lower pinching arm linkages. The grapple attachment assembly 210 of FIGS. 10 and 11 also is not depicted to include an insert member such as the one used for the grapple attachment assembly 10 of FIGS. 3 and 4. However, it may be provided with one. The grapple assembly includes an upper pinching arm 240, a lower pinching arm 242, and a rotation arm 252.

As in the grapple assembly 10 of FIGS. 1–5A, the rotation arm 252 includes an attachment cylinder connection 268, a first rotation arm connection 270, and a second rotation arm connection 272. The rotation arm 252 does not include a connection to the attachment arm 222.

The upper pinching arm 240 includes a first end 276 constructed for grappling an article and a second end 278 with a first attachment arm connection 280 and a first pinching arm connection 282. The first pinching arm connection 282 of the upper pinching arm 240 and the first rotation arm connection 270 of the rotation arm 252 are provided on the same axis. The connection between the first pinching arm 240 and the rotation arm 252 of the grapple assembly 210 may be provided by a curved slot 283 defined on the upper pinching arm 240 and a pin 271 defined on the rotation arm 252 that is slidably disposed within the slot 283.

The lower pinching arm 242 includes a first end 288 constructed for grappling an article and a second end 290 having a second attachment arm connection 292 and a second pinching arm connection 294. As in the upper pinching arm 240, the second pinching arm connection 294 of the lower pinching arm 242 and the second rotation arm connection 272 are provided on the same axis.

The individual components of the grapple assembly 210 of FIGS. 10 and 11 can be coupled to each other in a similar manner as previously described for the grapple assembly 10 of FIGS. 1–5A.

FIG. 10 illustrates a side view of the grapple assembly 210, showing the relative orientation of the individual components when the pinching arms 240 and 242 are in a closed position 246.

FIG. 11 illustrates a side view of the grapple assembly 210, showing the relative orientation of the individual parts when the pinching arms 240 and 242 are in an open position 244.

The relative layering of the individual components is shown in FIGS. 10 and 11 with hidden lines.

Figure 12B:
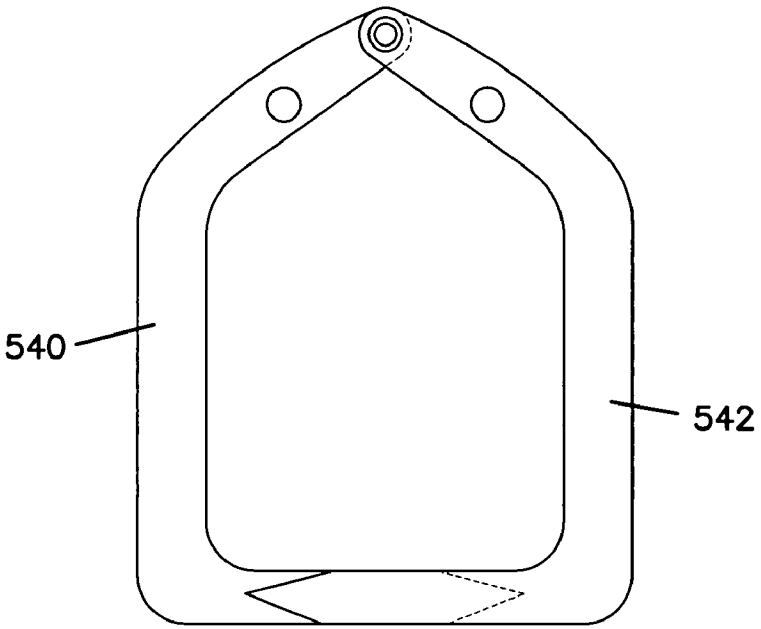
FIG. 12(*a*) is a side view of an alternative embodiment of pinching arms constructed for use with the grapple assemblies of FIGS. 1 and 6.
Figure 12A:
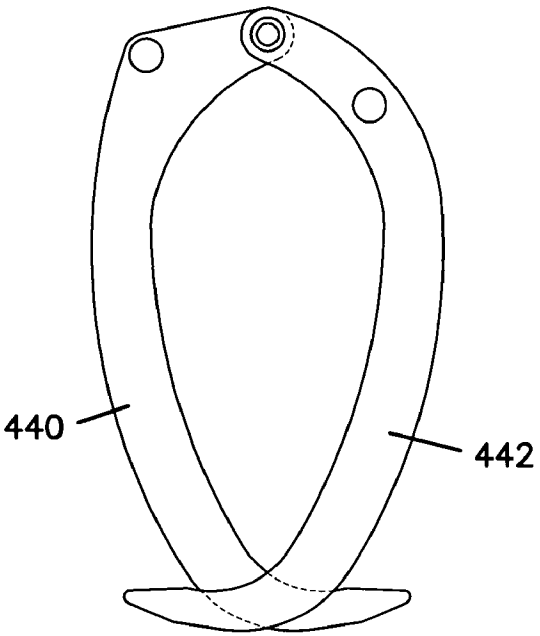

FIGS. 12(*a*)–(*b*) show side views of two alternative embodiments of the pinching arms 440, 442 and 540, 542, respectively, adapted for use with the grapple assemblies 10 and 110 according to the principles of the invention.

Figure 13:
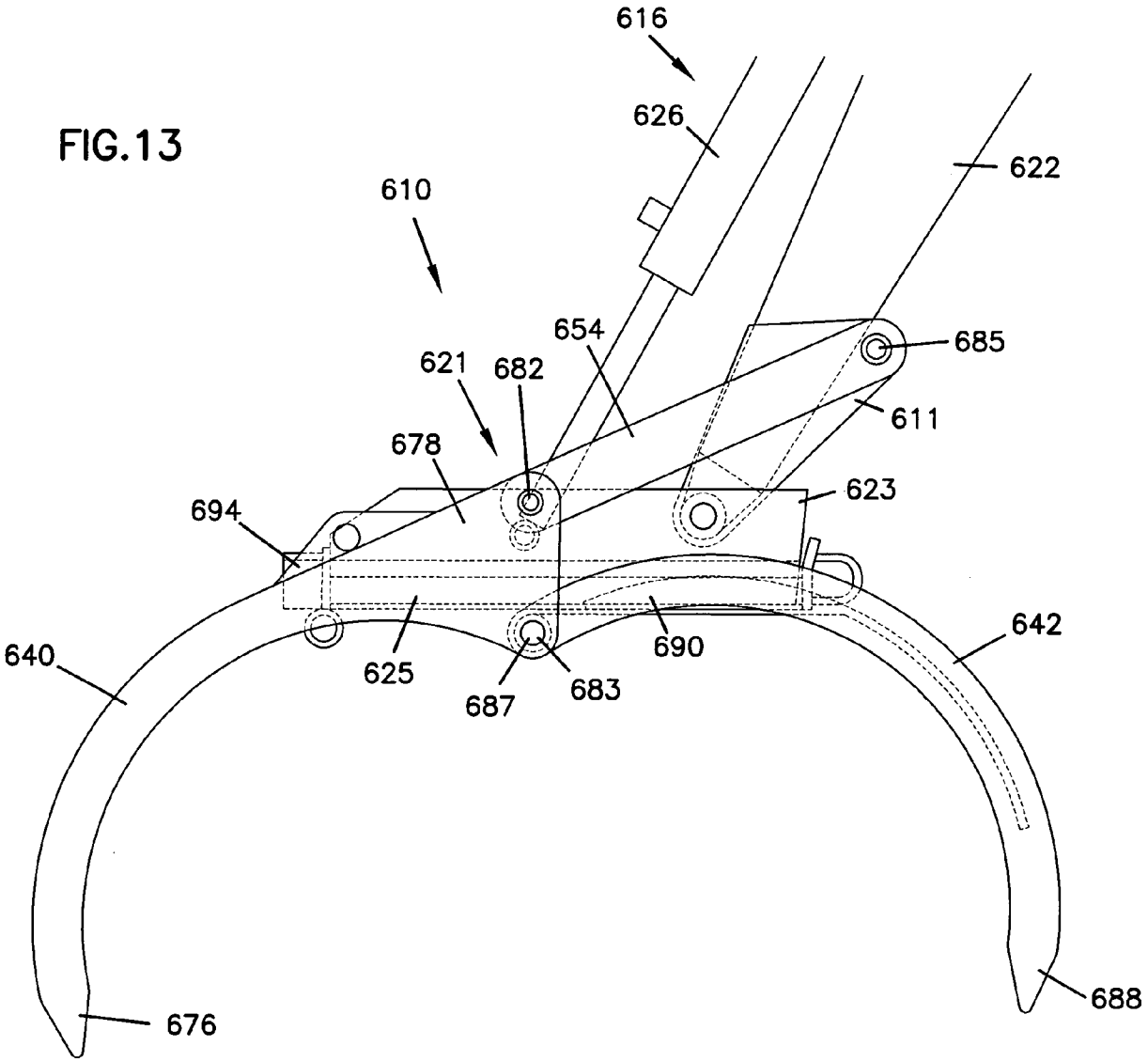
FIG. 13 is a side view of a fourth embodiment of a grapple assembly according to the principles of the invention, the grapple assembly including a quick attachment device.
Figure 14:
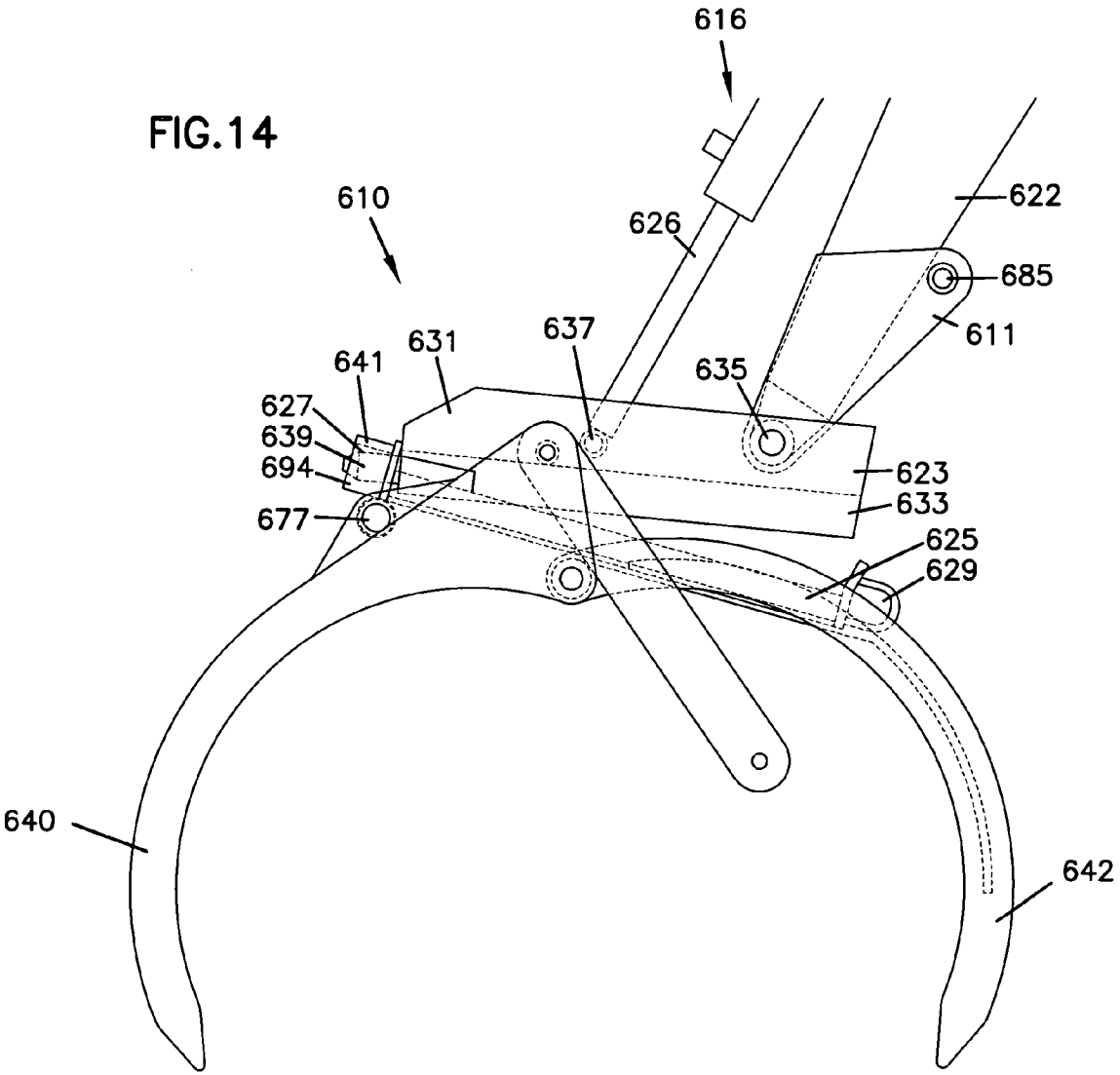
FIG. 14 is a side view of the grapple assembly of FIG. 13, showing the first pinching arm uncoupled from the boom assembly.
Figure 15:
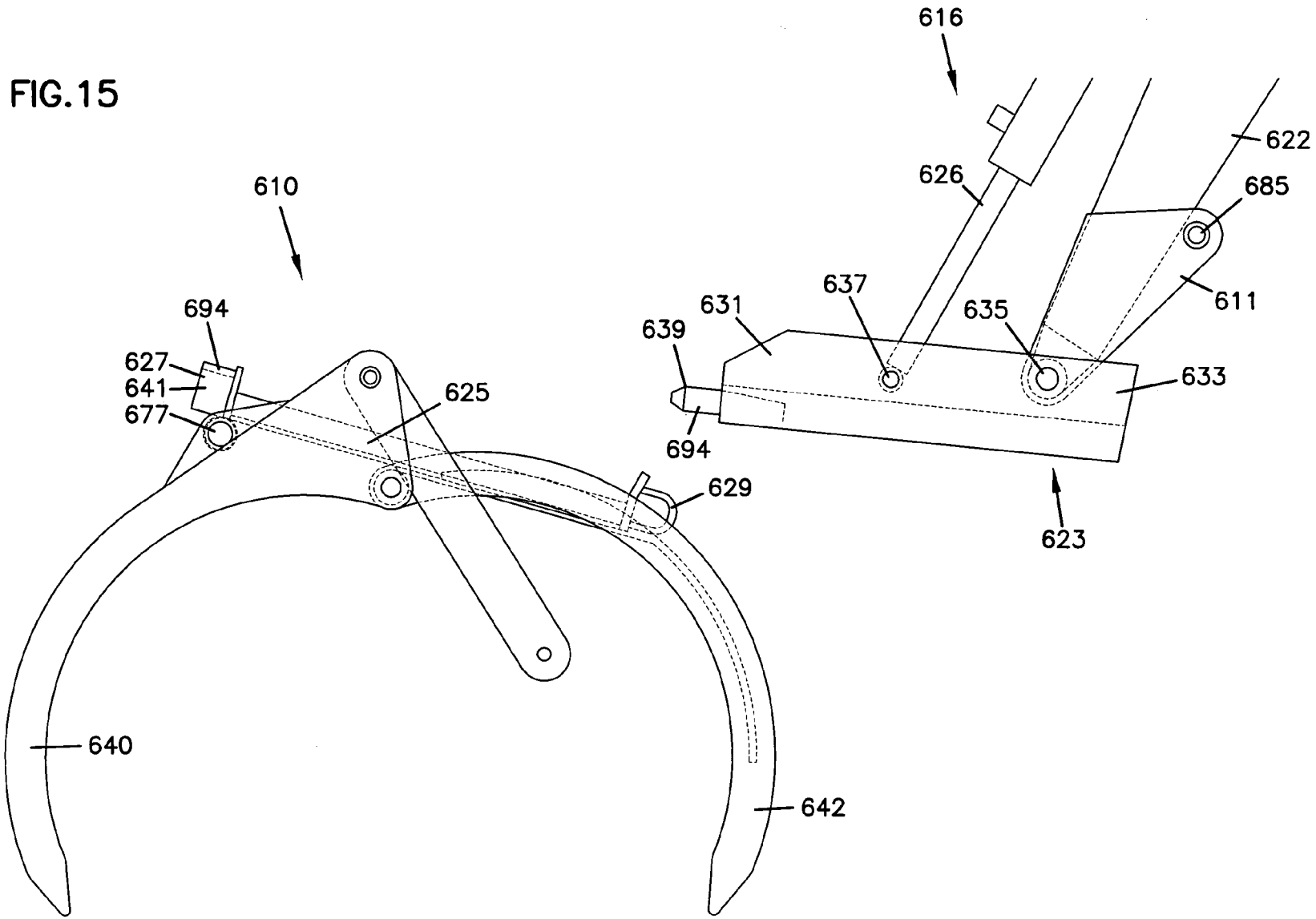
FIG. 15 is a side view of the grapple assembly of FIG. 13, showing the quick attachment arm of the quick attachment device uncoupled from the quick attachment arm receiver of the quick attachment device.

A fourth grapple assembly 610 according to the principles of the invention is illustrated in FIGS. 13–15. In addition to an upper pinching arm 640, a lower pinching arm 642, and an upper pinching arm linkage 654, the grapple assembly 610 of FIGS. 13–15 includes a quick attachment device 621. The quick attachment device 621 allows rapid attachment and detachment of the grapple assembly 610 to the boom assembly 616. Exemplary quick attachment devices that can be used according to the invention are described in U.S. Pat. No. 4,085,856 to Westendorf; U.S. Pat. No. 3,512,665 to Westendorf; U.S. Pat. No. 4,787,811 to Langenfeld et al., and U.S. Pat. No. 4,930,974 to Langenfeld et al. These patents are assigned to Westendorf Mfg. Co., Inc., which is the assignee of the above-identified patent application. These patents are incorporated herein by reference.

The quick attachment device 621 is shown having a quick attachment arm portion 623 that attaches to the front end loader and a quick attachment arm receiver portion 625 that is attached to the lower pinching arm 642. The quick attachment arm 623 and the quick attachment arm receiver 625 are constructed to attach together and detach from each other fairly easily.

Referring to FIGS. 13–15, the upper pinching arm 640 includes a first end 676 and a second end 678. The first end 676 of the upper pinching arm 640 is constructed for grappling an article. The second end 678 of the upper pinching arm 640 includes a first pinching arm connection 682 and a connection 683 for attachment to the lower pinching arm 642. The upper pinching arm 640 also includes a slot 677 adjacent the second end 678, the purpose of which will be explained in detail further below.

An attachment sleeve 611 similar to the attachment sleeve 111 used in the embodiment of the grapple assembly 110 of FIGS. 6–9 is utilized in the embodiment of FIGS. 13–15.

The upper pinching arm linkage 654 includes the first pinching arm connection 682 and an attachment arm connection 685. The upper pinching arm linkage 654 provides connection between the upper pinching arm 640 and the attachment arm 622 of the boom assembly 616.

The lower pinching arm 642 includes a first end 688 and a second end 690. The first end 688 is constructed for grappling an article. The second end 690 of the lower pinching arm 642 includes the quick attachment arm receiver 625 and a connection 687 for attachment to the upper pinching arm 640.

The quick attachment arm receiver 625 includes a first end 627 and a second end 629. The quick attachment arm receiver 625 includes a second pinching arm connection 694 at the first end 627. In the depicted embodiment, the quick attachment arm receiver 625 is fixedly coupled to the lower pinching arm 642. The quick attachment arm receiver 625 is not depicted to be coupled to the upper pinching arm 640 and the upper pinching arm 640 is movable relative to the quick attachment arm receiver 625. The quick attachment arm receiver 625 may be coupled to the lower pinching arm 642 by welding. The quick attachment arm receiver 625 may be fixedly coupled to the lower pinching arm in other ways including by fasteners and etc.

The quick attachment arm receiver 625 receives the quick attachment arm 623 to couple the grapple assembly 610 to the boom assembly 616 easily and efficiently. The quick attachment arm 623 (see FIG. 15) includes a first end 631 and a second end 633. The quick attachment arm 623 includes the second pinching arm connection 694 at the first end 631. Adjacent the second end 633, the quick attachment arm 623 includes an attachment arm connection 635. Between the first and second ends, the quick attachment arm 623 includes an attachment cylinder connection 637. The second pinching arm connection 694 of the quick attachment device 621 is provided with a quick attachment pin 639 constructed to be received within a quick attachment slot 641 that is provided at the second pinching arm connection 694 of the lower pinching arm 642.

FIGS. 14 and 15 illustrate the detachment of the grapple assembly 610 from the boom assembly 616 of a front end loader with the use of the quick attachment device 621. Referring to FIG. 14, the upper pinching arm linkage 654 is uncoupled from the sleeve 611 of the front arm 622 at the attachment arm connection 685. Once the upper pinching arm 640 is uncoupled from the boom assembly 616, the quick attachment arm 623 is uncoupled from the quick attachment arm receiver 625 by sliding the quick attachment pin 639 out of the quick attachment slot 641 at the second pinching arm connection 694.

As described above, the boom assembly connection 685 may be established by the use of a pin 675 (not shown in FIGS. 13–15) or any other type of a coupling structure. The pin 675 that is used at the attachment arm connection 685 can serve a double purpose. The pin 675, when it is not used to couple the upper pinching arm link member 654 to the attachment sleeve 611, can be inserted into the slot 677 defined on the upper pinching arm 640 to provide a means to keep the grapple assembly 610 in an uncollapsed and standing orientation when it is uncoupled from the boom assembly 616. The pin 675 abuts against the bottom surface of the quick attachment arm receiver 625 to prevent the lower pinching arm 642 from rotating relative to the upper pinching arm 640. This allows the quick attachment arm 623 coupled to the front end loader to be easily positioned to be attached to the quick attachment arm receiver 625.

The relative layering of the individual components is shown in FIGS. 13–15 with hidden lines.

The above specification, examples and data provide a complete description of the manufacture and the use of the composition of the invention. Since many embodiments of the invention can be made without departing from the spirit and scope of the invention, the invention resides in the claims hereinafter appended.

We claim:

1. A grapple assembly for attachment to a boom assembly, the grapple assembly comprising:

(a) a first pinching arm having a first end constructed for grappling an article and a second end constructed for attachment to the boom assembly at a first attachment arm connection, the first pinching arm having a first pinching arm connection;

(b) a second pinching arm having a first end constructed for grappling an article and a second end constructed for attachment to the boom assembly at a second attachment arm connection, the second pinching arm having a second pinching arm connection;

(c) a rotation arm including an attachment cylinder connection for attaching the rotation arm to an attachment cylinder of the boom assembly, the rotation arm having a first rotation arm connection and a second rotation arm connection, the first rotation arm connection provided on the rotation arm at a different location than the second rotation arm connection, the rotation arm also including an attachment arm connection for directly attaching the rotation arm to an attachment arm of the boom assembly;

(d) a first pinching arm linkage attached to the rotation arm at the first rotation arm connection and attached to the first pinching arm at the first pinching arm connection; and (e) a second pinching arm linkage attached to the rotation arm at the second rotation arm connection and attached to the second pinching arm at the second pinching arm connection;

(f) wherein rotation of the rotation arm relative to the boom assembly causes the first pinching arm and the second pinching arm to move between a closed position and an open position.

2. A grapple assembly according to claim 1, wherein the first attachment arm connection and the second attachment arm connection are provided with a pin.

3. A grapple assembly according to claim 1, further comprising an insert member.

4. A grapple assembly according to claim 1, wherein the attachment arm connection of the rotation arm is provided wit an attachment sleeve.

5. A grapple assembly according to claim 1, wherein the first pinching arm includes a right first pinching arm and a left first pinching arm.

6. A grapple assembly according to claim 5, wherein the second pinching arm includes a right second pinching arm and a left second pinching arm.

7. A grapple assembly according to claim 6, wherein the rotation arm includes a first rotation arm and a second rotation arm.

8. A front end loader comprising:

(a) a boom assembly including an attachment arm and an attachment cylinder;

(b) a grapple assembly attached to the boom assembly, the grapple assembly comprising:

(i) a first pinching arm having a first end constructed for grappling an article and a second end attached to the attachment arm at a first attachment arm connection, the first pinching arm having a first pinching arm connection;

(ii) a second pinching arm having a first end constructed for grappling an article and a second end attached to the attachment arm at a second attachment arm connection, the second pinching arm having a second pinching arm connection;

(iii) a rotation arm including an attachment cylinder connection for attaching the rotation arm to the attachment cylinder, the rotation arm having a first rotation arm connection and a second rotation arm connection, the first rotation arm connection provided on the rotation arm at a different location than the second rotation arm connection, the rotation arm also including an attachment arm connection for directly attaching the rotation arm to the attachment arm of the boom assembly;

(iv) a first pinching arm linkage attached to the rotation arm at the first rotation arm connection and attached to the first pinching arm at the first pinching arm connection; and (v) a second pinching arm linkage attached to the rotation arm at the second rotation arm connection and attached to the second pinching arm and the second pinching arm connection;

(c) wherein rotation of the rotation arm relative to the boom assembly of the front end loader causes the first pinching arm and the second pinching arm to move between a closed position and an open position.

9. A front end loader according to claim 8, wherein the front end loader includes a right boom assembly and a left boom assembly and wherein a right grapple assembly is attached to the right boom assembly and a left grapple assembly is attached to the left boom assembly.

10. A front end loader according to claim 9, further comprising a crossbar connecting the right boom assembly and the left boom assembly.

11. A front end loader according to claim 9, wherein the right grapple assembly is constructed to be operated by a right attachment cylinder and the left grapple assembly is constructed to be operated by a left attachment cylinder, wherein the right grapple assembly is constructed to be operated to grapple a different sized article than the left grapple assembly.

12. A method of operating a grapple assembly attached to a boom assembly, the method comprising the step of:

extending an attachment cylinder of the boom assembly to cause the grapple assembly to come to an open position, the grapple assembly comprising:

(a) a first pinching arm having a first end constructed for grappling an article and a second end attached to the boom assembly at a first attachment arm connection, the first pinching arm having a first pinching arm connection;

(b) a second pinching arm having a first end constructed for grappling an article and a second end attached to the boom assembly at a second attachment arm connection, the second pinching arm having a second pinching arm connection;

(c) a rotation arm including an attachment cylinder connection for attaching the rotation arm to the attachment cylinder, the rotation arm having a first rotation arm connection and a second rotation arm connection, the first rotation arm connection provided on the rotation arm at a different location than the second rotation arm connection, the rotation arm also including an attachment arm connection for directly attaching the rotation arm to an attachment arm of the boom assembly;

(d) a first pinching arm linkage attached to the rotation arm at the first rotation arm connection and attached to the first pinching arm at the first pinching arm connection; and (e) a second pinching arm linkage attached to the rotation arm at the second rotation arm connection and attached to the second pinching arm at the second pinching arm connection.

13. A method of operating a grapple assembly according to claim 12, further comprising the step of retracting the attachment cylinder of the boom assembly to cause the grapple assembly to come to a closed position.

* * * * *

UNITED STATES PATENT AND TRADEMARK OFFICE

CERTIFICATE OF CORRECTION

PATENT NO. : 7,160,077 B2
APPLICATION NO. : 10/934749
DATED : January 9, 2007
INVENTOR(S) : Westendorf et al.

It is certified that error appears in the above-identified patent and that said Letters Patent is hereby corrected as shown below:

Col. 5, line 2: "front comer 60, a lower back comer 62," should read --front corner 60, a lower back corner 62,--

Col. 5, line 3: "comer 64, and" should read --corner 64, and--

Col. 5, line 5: "front comer 60 for" should read --front corner 60 for--

Col. 10, line 67, claim 4: "wit an attachment" should read --with an attachment--

Col. 11, line 41, claim 8: "arm and the" should read --arm at the--

Signed and Sealed this

First Day of May, 2007

JON W. DUDAS
*Director of the United States Patent and Trademark Office*